United States Patent [19]

Weick

[11] 4,323,165

[45] Apr. 6, 1982

[54] BOTTLE CLOSURE

[75] Inventor: Heinz H. Weick, Geneva, Switzerland

[73] Assignee: Herkules AG, Menziken, Switzerland

[21] Appl. No.: 165,288

[22] Filed: Jul. 2, 1980

[30] Foreign Application Priority Data

Jul. 6, 1979 [CH] Switzerland ..... 6323/79
Nov. 28, 1979 [CH] Switzerland ..... 10560/79

[51] Int. Cl.[3] ..... B65D 41/30
[52] U.S. Cl. ..... 215/320; 220/306
[58] Field of Search ..... 215/320, 256; 220/306

[56] References Cited

U.S. PATENT DOCUMENTS 4,029,231 6/1977 Johnson ..... 215/256
4,244,480 1/1981 Planas ..... 215/320

FOREIGN PATENT DOCUMENTS 7104083 11/1972 Fed. Rep. of Germany .

*Primary Examiner*—George T. Hall
*Attorney, Agent, or Firm*—Fleit & Jacobson

[57] ABSTRACT

The present invention relates to a bottle closure comprising a push-on closure cap, on the inside of the end portion of which there is secured a rubber-elastic member 2 which serves to bear against the edge 4c of the mouth of a bottle, and also comprising resilient blade portions 1d which are disposed around the member 2 and which have detent portions 1e formed thereon, to engage under an annular projection 4b on the neck of the bottle. The invention provides that the rubber-elastic sealing member 2 is in the form of a peg-like member which, in the closed condition, bears sealingly with its free end surface 2a against the end face of the edge 4c of the mouth of the bottle, the length of the peg-like member corresponding at least to half the distance between the end portion 1b of the cap and the detent surfaces 1n. The blade portions 1d are also surrounded by a resilient ring 3.

9 Claims, 4 Drawing Figures

BOTTLE CLOSURE

The present invention relates to a bottle closure comprising a closure cap which can be pushed onto a bottle, comprising a bowl-shaped main body of any configuration in plan, to the inside of the end portion of which there is secured at an approximately central position a rubber-elastic member which serves for sealingly bearing against the edge of the mouth of the bottle, and further comprising a plurality of resilient blade portions which are formed on the inside of the end portion of the cap and which concentrically surround the rubber-elastic member in the manner of a longitudinally slotted hollow cylinder, which blade portions have detent portions formed thereon on the inside thereof in the region of their free ends, for resiliently engaging below an annular projection on the neck of a bottle.

Closure caps of this kind are used in particular for bottles, flasks and phials for cosmetic products.

In comparison with screw closures, push-on closure caps have the particular advantage that their configuration in plan view can be adapted to the respective shape of the bottle. Thus, a closure cap of oval, square, rectangular or the like plan configuration can engage over the upper region of a similarly shaped bottle, thereby permitting an elegant transition between the cap and the bottle or an aesthetically pleasing overall design in respect of the bottle when closed.

On the other hand, when screw closures are used, because of the rotary movement required and the fact that the final position in the rotary movement of the screw cap cannot be precisely ascertained, the cap is limited to a more or less round cross-section.

Figure 1:
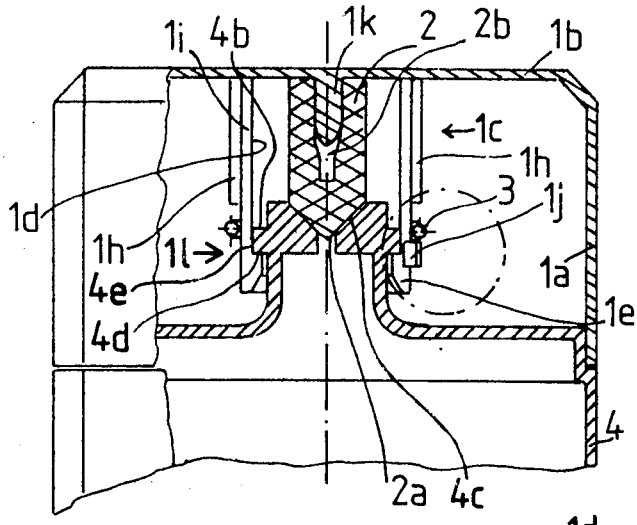
Figure 2:
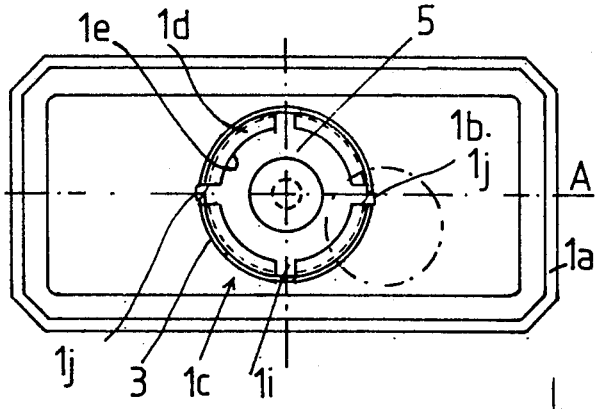

A bottle closure with a closure cap which can be pushed thereon, of the above-indicated kind, is shown in German utility model No. 7 104 083 (FIGS. 1 and 2). The axial sealing pressure required is produced by the resilient blade portions enclosing the annular projection on the neck of the bottle, with a relatively high radial pressure. As the blade portions must also provide a good long-lasting resilient action, the cap must comprise thermoplastic material which is of correspondingly high and therefore expensive quality.

While now on the one hand a reliable clamping action as between the cap and the neck of the bottle is an absolute necessity, on the other hand, attempts are made to provide for ease of handling of the cap, in particular ease in removing the cap from the bottle. These two requirements are diametrically opposed to each other. Hitherto, no-one has succeeded in reconciling these two requirements with each other, to the desired extent.

The present invention eliminates these disadvantages.

The present invention provides that the sealing member is in the form of a peg-like member which in the closure condition bears sealingly with its free end surface against the end edge of the mouth of the bottle, the length of the peg-like member corresponding at least to half the distance measured in the longitudinal direction thereof between the end portion of the cap and the detent surfaces of the projecting detent portions, and that the free end regions of the resilient blade portions are surrounded by a resilient ring which is retained in position in the longitudinal direction of the blade portions, on both sides, by portions formed thereon.

As the plane of the sealing action is at a relatively great distance from the end portion of the cap and as the free end of the peg-like member can be pivoted towards the side out of its longitudinal centre line, which is straight, this arrangement provides that the retaining action can be released by a tilting movement of the cap. The sealing end surface of the peg-like member can lift away from the mouth edge of the bottle as a result of a pivotal movement (even when the peg-like member has an end surface of conical or curved configuration), thereby permitting the above-mentioned tilting movement of the cap. In addition, the dimensions of the peg-like member ensure that the outside edge of the end surface of the neck of the bottle does not act on the inside against the blade portions as they disengage, during the tipping movement of the cap, which would hinder the operation of opening the bottle or which would bend the blade portions towards the side, so as to cause permanent deformation thereof.

As a result of the lever arm relationship which comes into effect in the operation of tilting the cap, this manipulation of the cap is much easier and more convenient to do than the usual operation of pulling the cap off, and can also be effected for example with one hand. A pressure is simply applied against one side wall of the cap, with the thumb of the hand which embraces the bottle.

Releasing the cap by a tilting movement also permits a greater detent pressure to be applied, thus giving a particularly reliable and safe seal. On the other hand, the pivotal movement which the blade portions must perform is greater than when the cap is pulled off. Account is taken of these considerations, by virtue of the resilient ring disposed around the blade portions.

With the cap according to the invention, there is, in itself, a certain danger in that an undesired impact on the side of the cap against a side wall thereof may result in the cap being released. This could happen for example if a pressure is applied to a bottle which is for example lying in a case on an uneven surface. The high detent pressure referred to above is also advantageous in this respect. In order further to increase the degree of security in this respect, in accordance with a further invention it is proposed that the detent projections and/or the annular projection on the neck of the bottle may be provided with a surface region which extends in the longitudinal direction of the bottle or the blade portions. If now, as a result of the cap being unintentionally subjected to a lateral force acting on the cap, the detent projections of the blade portions which are caused to pivot out on the corresponding side come out of their position of detent engagement, they do not immediately slide over the projection on the neck of the bottle, but initially slide onto the projection on the bottle neck. By virtue of the radial pressure applied by the blade portions, which increases at the same time, the cap is pressed back into its closure position in which it is completely held in locking engagement with the bottle. The bottle thus remains closed.

Figure 1A:
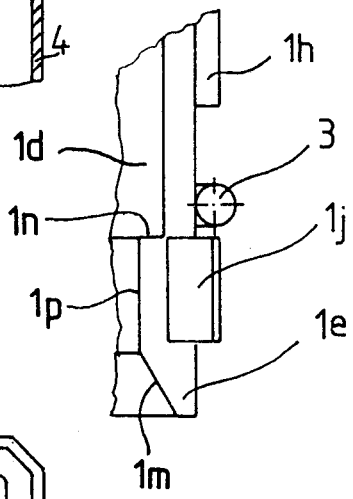
Figure 2A:
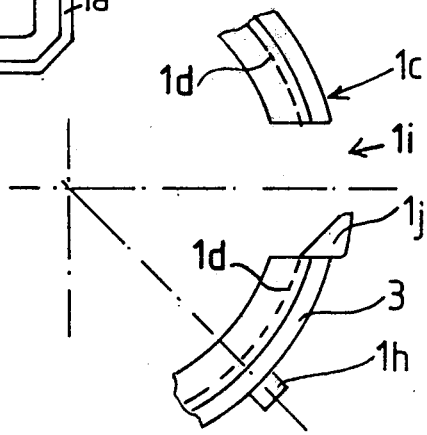

Further features of the invention are shown in the embodiment illustrated in the drawing in which:

FIG. 1 shows a view of a closure cap as shown in FIG. 2, including the upper region of a bottle, partly in section along line A—A, FIG. 1*a* shows a view on an enlarged scale of the detail indicated in FIG. 1 by a dash-dotted circle, FIG. 2 shows a view of the closure cap from below, and FIG. 2*a* shows a view on an enlarged scale through a detail indicated in FIG. 2 by a dash-dotted circle.

The closure cap comprises the bowl-shaped main body 1*a*, on the end portion 1*b* of which the rubber-elastic or resilient peg-like member 2 is arranged at a central position. The end surface 2*a* thereof is of a tapered configuration and lies under pressure against the end face of the edge 4*c* of the mouth of the bottle 4, which edge is also of a tapered configuration. At a radial spacing therefrom, the member 2 is surrounded concentrically by a cylindrical clamping sleeve 1*c* which is formed or moulded on the end portion 1*b* of the cap. As a result of the longitudinal slots 1*i* formed therein, the clamping sleeve 1*c* comprises the resilient blade portions 1*d* which are encircled by an inherently resilient ring 3 which preferably comprises metal or high-quality plastics material. The ring 3 is secured in position, towards the end portion 1*b* of the cap, by the longitudinal web portions 1*h* which are formed on the outside of the portions 1*d*. Projections 1*j* are provided for securing the ring in position in the direction towards the opening of the cap. The projections 1*j* are formed or moulded on corresponding resilient blade portions 1*d*, on narrow longitudinal surfaces which form the longitudinal walls of the slots, and on the one hand project into the corresponding slots 1*i* and on the other hand project slightly beyond the outside diameter of the arrangement of blade portions, which is in the form of a kind of hollow cylinder.

The end regions of the resilient blade portions 1*d* are provided on their inside with detent projections 1*e* which are tapered towards the opening of the cap and which engage under the annular projection 4*b* on the neck of the bottle.

Going towards the end portion 1*b* of the cap, the tapered end surfaces 1*m* of the detent projections 1*e* initially go into an intermediate surface 1*p* which is disposed approximately in the longitudinal direction of the blade portion and which adjoins the detent surface 1*n* which is directed transversely with respect to the longitudinal direction of the blade portion.

Above its detent surface 4*d* which is directed transversely with respect to the longitudinal direction of the bottle, the annular projection 4*b* on the neck of the bottle has an approximately cylindrical peripheral region 4*e*. For securing the resilient peg-like member 2 to the end portion 1*b* of the cap, a pin portion 1*k* which is formed or moulded on the end portion 1*b* engages into the peg bore 2*b* which is in itself narrower than the pin portion 1*k*, thereby forming a self-clamping mounting seat.

If, for the purposes of removing the cap, a manual pressure is applied to one of the broad side surfaces of the cap, it has a tendency to pivot up about the lower edge of the opposite broad side wall which in that case bears against the corresponding edge of the bottle. As the sealing surfaces 2*a* and 4*c* are at a relatively large distance from the end portion 1*b* of the cap, and as the end of the peg-like member, as a result of the length thereof, is flexible transversely with respect to the axis of the peg-like member, which is a straight line, the arrangement permits a tilting movement. When this happens, the end surface 2*a* is lifted away from the edge 4*c* of the bottle, with the peg-like member 2 simultaneously being curved to a greater or lesser extent, in dependence on the conicity of the sealing surfaces 2*a* and 4*c*.

In this respect, the arrangement also ensures that the outside edge of the end face of the neck of the bottle is not pressed against the portions 1*d*, which would damage the portions 1*d* or make the tilting operation more difficult to perform.

It will be readily seen that the blade portions 1*d* which are disposed on the side of the cap which pivots up will become disengaged first, followed subsequently by the blade portions which are disposed opposite thereto.

As a result of the resilient ring 3, the desired detent force is no longer determined, or is determined only to an insubstantial degree, by the blade portions 1*d*. An inexpensive material can thus be used for the main body of the cap. The resilient ring 3 which can be adapted without difficulty to the desired closure qualities, guarantees a detent and release function which always remains mild and gentle, in spite of having a high detent force. There is no possibility of defective closure due to material fatigue.

The danger of unintentional opening of the bottle as a result of an outside force acting thereon (for example when a bottle is in a travel case) is also taken into account. The detent projections 1*e* which come out of a condition of detent engagement on one side as a result of such a force acting on the cap do not immediately slide over the projection 4*b* at the neck of the bottle, but initially slide onto the projection, because of the surface regions 1*p* and 4*e*. The radial pressure of the portions 1*d*, which is increased at the same time, causes the cap to be pressed back into its closure position in which it is completely in a condition of detent engagement. In addition, the higher detent pressure produced by the resilient ring 3 provides a higher degree of safety.

Fixing the member 2 in position by means of the pin portion 1*k* has the advantage that there is no need for an additional adhesive connection.

As a result of the pressure with which the end surface 2*a* of the member 2 bears against the edge 4*c* of the mouth of the bottle, there is adhesion of greater or lesser magnitude between the contact surfaces 2*a* and 4*c*. When the cap is removed, the adhesion effect acts as a pulling force on the member 2 which must therefore be securely connected to the end portion 1*b* of the cap. As however the pulling force causes the member 2 to be stretched so that its cross section is reduced, the bore 2*d* obviously also has a tendency to be reduced in size. Consequently, the pin portion 1*k* is embraced with an increasing pressure so that the non-adhesive connection withstands the traction loading.

It is obviously also possible for the end surface 2*a* of the peg-like member to be of a curved configuration. In addition, the spatial configuration of the said end surface could also be such as to be set back, assuming a corresponding co-operating configuration in respect of the end surface of the neck of the bottle.

As an alternative to a round cross-section as illustrated, the resilient ring 3 may also comprise flat material and may non-rotatably engage with a bead or bend into a slot 1*i*.

I claim:

1. A bottle closure comprising a closure cap which can be pushed onto a bottle, comprising a bowl-shaped main body of any configuration in plan, to the inside of the end portion of which there is secured at an approximately central position a rubber-elastic member which serves for sealingly bearing against the edge of the mouth of the bottle, and further comprising a plurality of resilient blade portions which are formed on the inside of the end portion of the cap and which concentrically surround the rubber-elastic member in the manner of a longitudinally slotted hollow cylinder, which blade portions have detent portions formed thereon on the inside thereof in the region of their free ends, for resiliently engaging below an annular projection on the neck of a bottle, characterised in that the sealing member (2) is in the form of a peg-like member which in the closure condition bears sealingly with its free end surface (2*a*) against the end edge (4*c*) of the mouth of the bottle, the length of the peg-like member corresponding at least to half the distance measured in the longitudinal direction thereof between the end portion (1*b*) of the cap and the detent surfaces (1*n*) of the projecting detent portions (1*e*), and that the free end regions of the resilient blade portions (1*d*) are surrounded by a resilient ring (3) which is retained in position in the longitudinal direction of the blade portions, on both sides, by portions (1*h*, 1*j*) formed thereon.

2. A closure according to claim 1 characterised in that the peg-like member (2) extends at least approximately to the detent plane (1*i*) defined by the detent surfaces (1*n*).

3. A closure according to claim 1 characterised in that the resilient blade portions (1*d*) surround the neck region of the bottle which is above the projection (4*b*) on the neck of the bottle, at a radial spacing therefrom, when the cap (1*a*, 1*b*) is fitted into place.

4. A closure according to claim 1 characterised in that the detent projections (1*e*) of the resilient blade portions (1*d*) are provided, between tapered end surfaces (1*m*) and detent surfaces (1*n*) which are directed transversely with respect to the longitudinal direction of the blade portions, with intermediate surfaces (1*p*) which extend approximately in the longitudinal direction of the blade portions.

5. A closure according to claim 1 characterised in that the annular projection (4*b*) on the neck of the bottle has an approximately cylindrical peripheral portion (4*e*), beside a detent surface (4*d*) which extends transversely with respect to the longitudinal direction of the bottle.

6. A closure according to claim 1 characterised in that the free end face (2*a*) of the sealing member (2) is of a curved or conical three-dimensional configuration.

7. A closure according to claim 1 characterised in that the peg-like member (2) is provided with an axial bore which is open to the end portion (1*b*) of the cap and into which a pin member (1*k*) which is formed on the end portion (1*b*) of the cap and which is thicker than the initial diameter of the axial bore (2*b*) self-clampingly engages.

8. A closure according to claim 1 characterised in that at least one of the resilient blade portions (1*d*) is provided on at least one of its longitudinal surfaces forming the slots (1*i*), with a projection (1*j*) which is formed thereon and which projects into the corresponding slot (1*i*), which projection secures the inherently resilient ring (3) in position in a direction towards the opening of the cap.

9. A closure according to claim 8 characterised in that the projection (1*j*), as viewed in an elevational view of the cap, projects somewhat beyond the outside diameter of the arrangement (1*c*) of blade portions in a hollow cylindrical-like configuration.

* * * * *